US005914672A

United States Patent [19]

Glorioso et al.

[11] Patent Number: 5,914,672

[45] Date of Patent: Jun. 22, 1999

[54] SYSTEM FOR FIELD INSTALLATION OF A REMOTE METER INTERFACE

[75] Inventors: Charles A. Glorioso, Castro Valley; Ali R. Naddaf, San Jose, both of Calif.

[73] Assignee: Whisper Communications Incorporated, Sunnyvale, Calif.

[21] Appl. No.: 08/874,684

[22] Filed: Jun. 13, 1997

[51] Int. Cl.[6] ..... G08C 15/00

[52] U.S. Cl. ..... 340/870.02; 340/870.03; 340/870.11; 340/637; 324/110; 375/206; 455/412; 455/426

[58] Field of Search ..... 340/870.02, 870.03, 340/870.06, 870.11, 870.28, 637; 379/106.01, 106.03; 375/200, 206; 324/110; 455/412, 426

[56] References Cited

U.S. PATENT DOCUMENTS 4,799,059 1/1989 Grindahl ..... 340/870.03
5,056,107 10/1991 Johnson et al. .
5,526,401 6/1996 Roach ..... 455/426
5,546,444 8/1996 Roach ..... 455/412
5,553,094 9/1996 Johnson et al. .
5,748,104 5/1998 Argyroudis ..... 340/870.11

*Primary Examiner*—Michael Horabik
*Assistant Examiner*—Albert K. Wong
*Attorney, Agent, or Firm*—David R. Gildea

[57] ABSTRACT

A system of multiple remote meter interfaces (RMI)s and multiple base stations. Each base station concentrates meter reading information received from several RMIs and passes the concentrated information up through a wide area network to a central office. Each RMI may be field installed to communicate with only one base station. Each base station maintains an identification (ID) list having its own base station ID and the RMI IDs for the RMIs with which the base station is enabled to communicate. To install or reinstall a particular RMI without communicating with the central office, a field installer tool operated by a field installation or repair person establishes communication with the base station using the base station ID, then directs the base station to add the RMI ID for the particular RMI to the ID list.

19 Claims, 3 Drawing Sheets

SYSTEM FOR FIELD INSTALLATION OF A REMOTE METER INTERFACE

BACKGROUND OF THE INVENTION

1. Field of the Invention

The invention relates generally to systems for wireless communication between multiple remote meter interfaces (RMI)s and multiple base stations and more particularly to a system for field installation of a particular RMI to a particular base station.

2. Description of the Prior Art

Wireless communication systems are commonly used for sending information from remote locations to a central office. These systems include a remote interface for reading and transmitting information regarding a physical result and a communication network. Typically, the communications network includes local base stations situated on a grid for concentrating the information received in wireless signals from several remote interfaces and a wide area network (WAN) for forwarding the concentrated information to the central office. The WAN may use another wireless system or a wired system such as telephone landlines or cable television lines. The systems may be bi-directional to include the capability of sending control information from the office back to the remote interface. One important application for remote interfaces is for reading utility meters and transmitting the meter reading information in a wireless data signal. Such remote interfaces are known as appliance interface modules (AIM)s or remote meter interfaces (RMI)s.

It is likely that more than one base station will be situated near enough to an RMI to receive energy from the wireless data signal from that RMI. Although having multiple base stations receive the same wireless data signal may be used to provide redundancy, this use of the base stations and the WAN is less efficient because the same information will be sent multiple times. Further, complex software must be developed for the central office to deal with the multiple receptions the same information. The software will be especially complex in bidirectional systems where control information is sent back from the central office in response to the meter reading information. One solution to these problems is to designate a particular one of the base stations to communicate with each particular RMI so that the RMI can communicate only with that base station. In existing systems an identification for a designated RMI is downloaded via the WAN from the central office software to the base station. This identification is stored in the base station to designate an RMI with which the base station is enabled to communicate. However, it is sometimes difficult for a worker in the field who is installing or reinstalling an RMI to get control of the central office software in order to pass the identification through the WAN to the base station.

BRIEF SUMMARY OF THE INVENTION

It is therefore an object of the present invention to provide a method for field installation of a remote interface in a system having multiple remote interfaces and multiple base stations, whereby only one of the base stations is enabled in the field to recognize a wireless data signal from a particular remote interface.

Another object of the present invention is to provide a method for installing a particular remote interface to a particular base station without reducing the capacity of the base station for communicating with other remote interfaces.

Another object of the present invention is to provide a base station that may be enabled from the field to recognize a wireless data signal from a particular remote interface.

Another object of the present invention is to provide a system having an installer tool for enabling a base station to recognize a wireless data signal from a remote interface.

Briefly, a preferred embodiment of a system of the present invention includes multiple remote meter interfaces (RMI)s for reading meters and transmitting wireless data signals including meter readout information; multiple base stations for receiving the wireless data signals where each particular base station recognizes the wireless data signal only from particular RMIs that have been identified to the base station, concentrating the information from the identified RMIS, and passing the concentrated information to a central office through a wide area network (WAN); and an installer tool for transmitting a wireless installation signal to the particular base station for identifying the RMIs to the particular base station. The base station includes a receiver for receiving the wireless data signal, a transmitter for passing concentrated information to the WAN, and a microcontroller including an identification (ID) list including the IDs of the RMIs with which the base station is enabled to communicate.

An advantage of a field installation method of the present invention is that only one of the base stations is enabled to recognize a wireless data signal from a particular remote interface, thereby increasing the efficiency of the use of the airwaves, decreasing the cost of the system, and eliminating the need for software to deal with redundant information.

Another advantage of a method of the present invention is that a base station is enabled to communicate with a remote interface without reducing the time allocated for scheduled communications with other remote interfaces.

Another advantage of the present invention of a base station is that the base station may be enabled from the field to recognize a wireless data signal from a particular remote interface.

Another advantage of the present invention is that a system includes an installer tool for enabling a base station to recognize a wireless data signal from a remote interface.

These and other objects and advantages of the present invention will no doubt become obvious to those of ordinary skill in the art after having read the following detailed description of the preferred embodiments which are illustrated in the various figures.

DETAILED DESCRIPTION OF THE INVENTION

Figure 1:
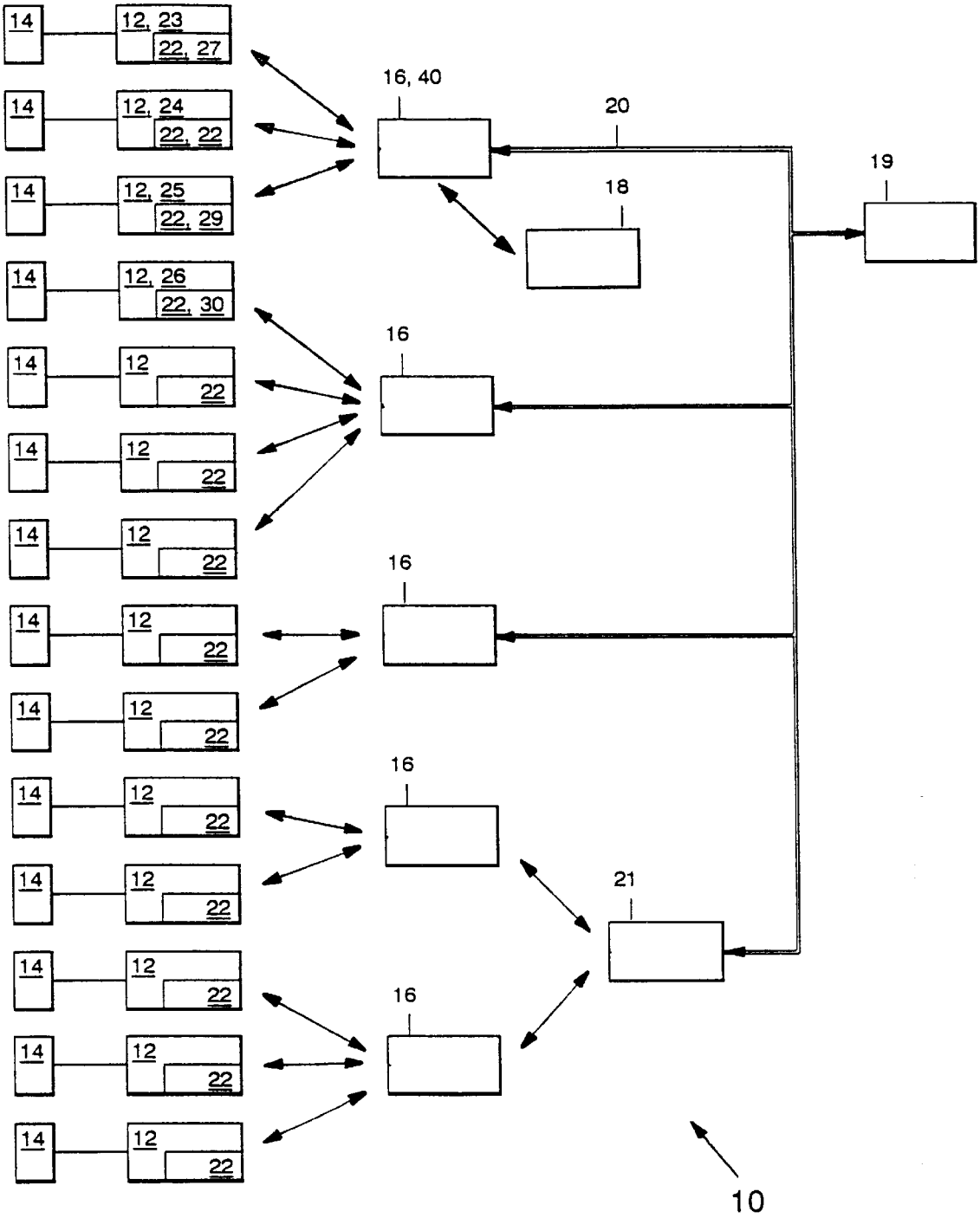
FIG. 1 is a block diagram of a system of the present invention whereby an installation tool enables a base station to communicate with a remote meter interface (RMI)

FIG. 1 illustrates a block diagram of a system of the present invention referred to by the general reference number 10. The system 10 includes multiple remote meter interfaces (RMI)s 12 for reading meters 14, multiple base stations 16 for receiving meter reading information by wireless signals from the RMIs 12, and an installer tool 18. The installer tool 18 is operated by a field repair or installation person for communicating by wireless signals to the base stations 16 for installing the RMIs 12 to the base stations 16. The meters 14 may be but are not limited to meters for measuring gas, water, electric flow, or the like; and sensors for measuring temperature, pressure, humidity, motion, contact closure, or the like.

Each of the base stations 16 concentrates the meter reading information from several of the RMIs 12 and then passes the information to a central office 19 via a wide area network (WAN) 20. Alternatively, the base stations 16 may act as repeaters to pass the meter reading information to a master station 21. The master station 21 then passes the information through the WAN 20 to the central office 19. Where the master station 21 is used, either or both of the base stations 16 and the master station 21 may concentrate the meter reading information. There may be more than one master station 21 in the system 10. In a preferred embodiment the RMIs 12, base stations 16, installer tool 18, and master station 21 communicate in signal bursts having thirty bytes per burst. A fast rate for the system is one burst per minute from one of the RMIs 12. It will be appreciated that at thirty bytes per minute, communication efficiency is of major importance in the system 10 and that redundant communications are to be avoided. In order to prevent redundant communications, the system 10 is designed so that each one of the RMIs 12 communicates with only one of the base stations 16. The RMIs 12 are identified, respectively, with a unique RMI ID 22. In a preferred embodiment the RMI ID 22 corresponds to the serial number of the respective one of the RMIs 12 that the RMI ID 22 identifies. Although any one of the RMIs 12 may be within range of several of the base stations 16, only the base station 16 that is enabled to recognize the RMI ID 22 of that one of the RMIs 12 will receive and respond to that one of the RMIs 12.

The WAN 20 may be wired or wireless and is commercially available from several sources including landline telephone companies such as Pacific Telesis Company, known as Pacific Bell of San Francisco, Calif., hybrid fiber optic and coax cable television companies, cellular telephone providers, cellular telephone providers having CDPD protocol for piggy backing digital data on an analog cellular telephone, and providers of specialized wireless services such as Metricom of Los Gatos, Calif.

Preferably, the wireless signals between the RMIs 12, the base stations 16, and the master station 21 in the system 10 are signal bursts within a carrier frequency range of 902 to 928 MHz. The communications are originated by the RMIs 12 and continued on a scheduled basis thereafter. During each signal burst, the carrier signal frequency hops in a pseudo-random sequence through fifty of one-hundred twenty-eight designated frequency channels within the frequency range. As a special case, the RMIs 12 that have not been installed before are allowed to use only three channels for installation. In operation, one of the RMIs 12 transmits a data signal burst to one of the base stations 16. The one of the base stations 16 receiving a data signal burst responds by transmitting a return signal burst. The round trip of the signal bursts is less than four-hundred milliseconds long in order to meet a Federal Communications commission (FCC) regulation for spread spectrum communication. The meter reading information is carried by frequency shift key (FSK) modulation at a rate of about two kilobaud and a deviation of about six kilohertz. The RMIs 12 and the base stations 16 for receiving and transmitting such wireless signals are disclosed in the U. S. patent application Ser. No. 08/376,109 filed Jan. 20, 1995 by Farrer et al., incorporated herein by reference. Of course, other frequency ranges, signal formats, and modulation schemes could as well be used and the invention does not depend upon the specific frequency range, signal format, and modulation scheme described in the above U.S. patent application.

In the description below, an exemplary group of the RMIs 12 designated as RMIs 23–26 having the RMI ID 22 designated as an RMI ID 27–30, respectively, have been installed at a previous time to an exemplary one of the base stations 16 designated as base station 40. The RMIs 23–24 are representative of the RMIs 12 that are actively communicating on a scheduled basis with base station 40; the RMI 25 is representative of the RMIs 12 that have been enabled to the base station 40 but are not actively communicating; and the 26 is representative of a particular one of the RMIs 12 that is to be installed to the base station 40 by the installer tool 18 according to the present invention.

Figure 2:
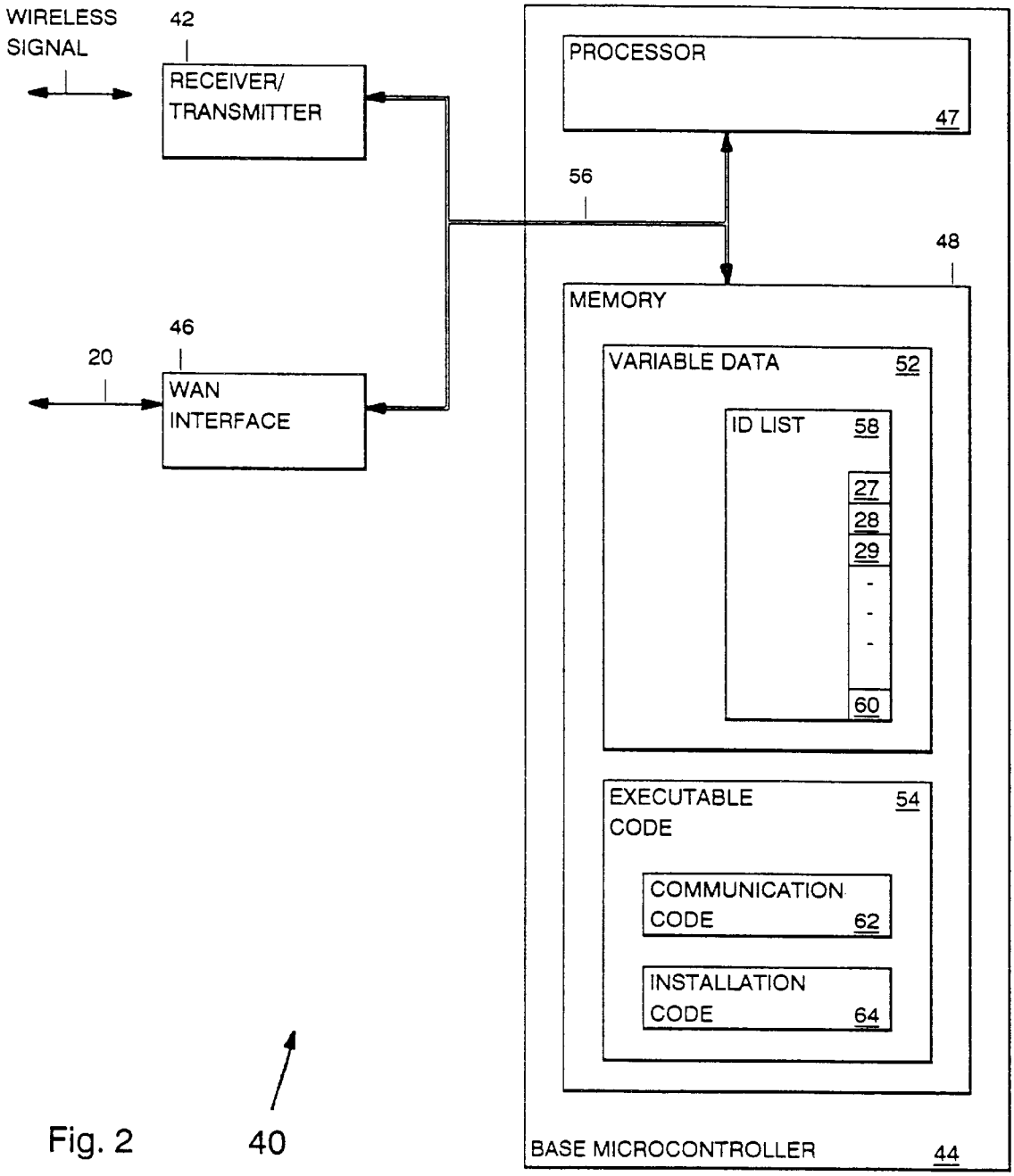
FIG. 2 is a block diagram of the base station of FIG. 1.

FIG. 2 is a block diagram of the particular base station 40 to which the particular RMI 26 (FIG. 1) is to be installed. The base station 40 includes a receiver/transmitter 42, a base microcontroller 44, and a WAN interface 46. The WAN interface 46 includes a serial interface and may include an additional interface that depends upon the particular type of the WAN 20 that is used for the system 10. In the case where the WAN 20 uses a hybrid fiber coax television network the WAN interface 46 includes a cable modem for modulating data on the RF carrier carried on the cable. For a telco dialup the WAN interface 46 includes a telephone modem. For the Metricom wireless network the WAN interface 46 includes a Ricochet wireless modem available from Metricom. For a cellular telephone the WAN interface 46 may include a CDPD modem.

The receiver/transmitter 42 includes all of the structural elements required for receiving and transmitting the wireless signals including one or more antennas, radio frequency filters, combiners, low noise amplifiers, power amplifiers, couplers, downconversion circuits, synthesizers, baseband filters, frequency discriminators, bit synchronizers, frame synchronizers, and gates. An example of such receiver/transmitter 42 operating in half-duplex with the same frequency for transmit and receive using direct up conversion from and down conversion to baseband is shown in the U. S. patent application Ser. No. 08/376,106 referred to above. The receiver/transmitter 42 receives and transmits the wireless signal bursts over the air, and issues and receives representative digital data signals to and from the base microcontroller 44.

The base microcontroller 44 includes a processor 47 and a memory 48 including variable data 52 and an executable code 54. The processor 47 operates in a conventional manner according to instructions in the executable code 54 and digital values in the variable data 52 to receive and issue digital signals and to control the elements of the base station 40 via a microcontroller bus 56. The variable data 52 includes an identification (ID) list 58 including a base station ID 60 corresponding to the base station 40, the respective RMI ID 27–28 (FIG. 1) for the active RMIs 23–24 (FIG. 1), and the RMI ID 29 (FIG. 1) for the RMI 25 (FIG. 1) that is representative of the RMIs 12 (FIG. 1) that are enabled but not active. In a preferred embodiment the base station ID 60 corresponds to the serial number of the base station 40. The executable code 54 includes a communication code 62 and an installation code 64. The communication code 62 includes instructions for communicating with the active RMIs 23–24 and with the WAN interface 46 for passing data up to the central office 19 (FIG. 1) and control information down to the RMIs 23–24 and for scheduling the communications with the RMIs 23–24. The communication code 62 causes the base station 40 to alternate between a first or scheduled time segment for the scheduled communications and a second or acquisition time segment. In a preferred embodiment the scheduled time segment is two seconds and the acquisition time segment is four seconds for a cycle time of six seconds. The base station 40 receives a wireless data signal and typically responds by transmitting a wireless return signal to one of the scheduled RMIs 23–24 during each of the scheduled time segments enabling the base station 40 to have ten scheduled communications per minute. In an hour the base station 40 can serve up to six hundred different RMIs 23–24; one of the RMIs 23–24 six hundred times; or a combination of fewer than six hundred RMIs 23–24 where some of the RMIs 23, 24 are serviced more than once during the hour. The base stations 16 (FIG. 1) that communicate via the master station 21 (FIG. 1) have nine scheduled RMI communications per minute and use the tenth time for master station communication.

The installation code 64 includes instructions for installing or reinstalling the representative RMI 25 whose RMI ID 29 is currently in the ID list 58 and for receiving information for enabling the particular RMI 26 by adding the corresponding RMI ID 30 to the ID list 58 in preparation for installation. There are two ways in which the RMI ID 30 may be added. First, the RMI ID 30 may be downloaded from the central office 19 (FIG. 1) via the WAN 20 to the WAN interface 46 and passed by the WAN interface 46 to the base microcontroller 44. However, in several embodiments of the WAN 20, it is not practical for the field repair or installation person to get the attention of the central office 19 in order for the downloading to proceed. Second, and preferably, the RMI ID 30 is received in a wireless installation signal from the installer tool 18 (FIG. 1) as illustrated in the flow chart of FIG. 3 and described in the accompanying detailed description, below.

Figure 3:
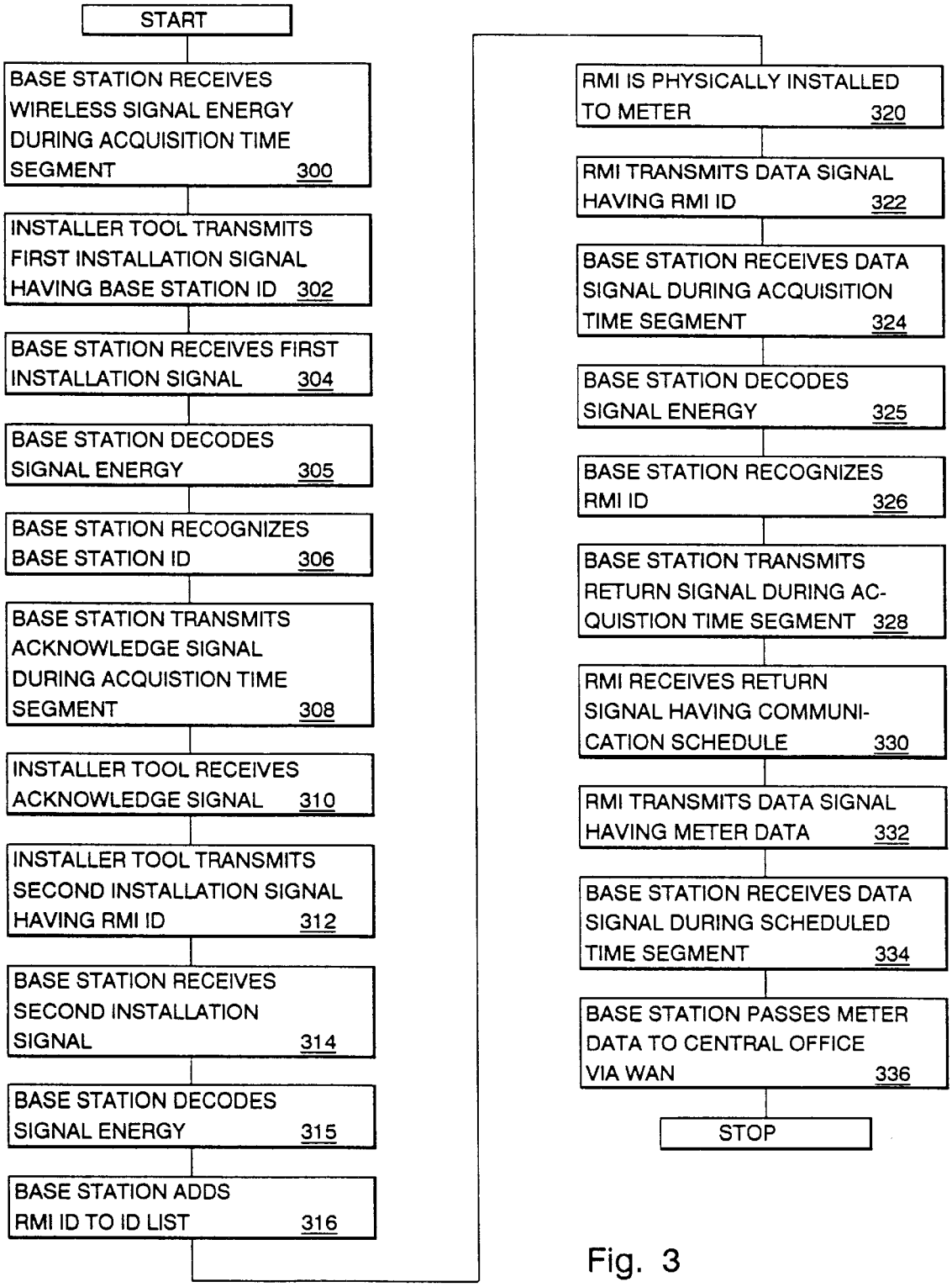
FIG. 3 is a flow chart of a method in the system of FIG. 1 whereby the installer tool enables the base station to communicate with the RMI.

FIG. 3 is a flow chart of the way in which the installer tool 18 and the base station 40 communicate for installing the RMI 26. In a step 300 the base station 40 is controlled by the communications code 62 to alternate between the scheduled time segment for scheduled communications with the RMIs 23–24 and the acquisition time segment. During the scheduled time segments the base station 40 is communicating with the RMIs 23 and 24. During the acquisition time segments the receiver/transmitter 42 is controlled by the base microcontroller 44 acting on instructions in the installation code 64 for receiving wireless signal energy at a frequency that is dithered about one of the channels that is used by the RMI 25 and/or the installer tool 18. In a preferred embodiment the frequency dither is approximately forty-five kilohertz. The particular channel is selected based upon a low background noise. When signal energy is received, the receiver/transmitter 42 demodulates and synchronizes to the received signal energy and passes a responsive digital signal to the base microcontroller 44. The base microcontroller 44 decodes the digital signal and follows instructions in the installation code 64 to attempt to recognize the RMI ID 29 or the base ID 60. In a step 302 the field repair or installation person inputs the base station ID 60 corresponding to the base station 40 into the installer tool 18 and the installer tool 18 transmits a first wireless installation signal burst including the base station ID 60. In a step 304 the base station 40 receives signal energy for the first installation signal during the acquisition time segment. In a step 305 the base station 40 decodes the first installation signal. In a step 306 the base station 40 recognizes its own base station ID 60. In a step 308 the base station 40 responds during the acquisition time segment by transmitting an acknowledgment signal scheduling a time and a time cycle for future transmissions from the installer tool 18. These communications are scheduled during the acquisition time segment, thereby allowing the base station 40 to continue scheduled communications at full capacity. In a step 310 the installer tool 18 receives the acknowledgment signal. In a step 312 the field person inputs the RMI ID 30 corresponding to the RMI 26 into the installer tool 18 and the installer tool 18 responds at the scheduled time with a second wireless installation signal including information for the RMI ID 30. In a step 314 the base station 40 receives signal energy for the second installation signal burst during the acquisition time segment. In a step 315 the base station 40 decodes the signal energy for the second installation signal. In a step 316 the base station 40 follows instructions in the installation code 64 for adding the RMI ID 30 to the ID List 58. The base station 40 has now been enabled to communicate with the RMI 26 and will now attempt to recognize the RMI ID 30.

In an asynchronous step 320 before or preferably after the base station 40 has been enabled for the RMI ID 30, the field installation person physically installs the RMI 26 to read the corresponding meter 14. In a step 322 RMI 26 transmits a wireless data signal burst including its RMI ID 30. In a preferred embodiment, when the RMI 26 is being installed for the first time, the data signal burst has three predetermined frequency channels for frequency hopping. When the RMI 26 is being re-installed after operating at some previous time the data signal burst has fifty predetermined frequency channels for frequency hopping. In a step 324 the base station 40 receives signal energy for the wireless data signal during the acquisition time segment. In a step 325 the base station 40 decodes the signal energy for the data signal. In a step 326 the base station 40 recognizes the RMI ID 30. In a step 328 the base station 40 responds by transmitting a wireless return signal to the RMI 26 to schedule future communications during the scheduled time segment. The return signal burst is transmitted using the actual frequency and actual time of the wireless data signal as the basis for the frequency of the wireless return signal. In a step 330 the RMI 26 receives the return signal burst. In a step 332 the RMI 26 transmits a wireless data signal including application data read from the corresponding meter 14. In a step 334 the base station 40 receives the wireless data signal including the application data. In a step 336 the base station 40 passes the application data via the WAN 20 to the central office 19. The installer tool 18 and the base station 40 may continue to communicate during the acquisition time segment while the RMIs 23, 24, and 26 and the base station 40 are communicating during the scheduled time segment. Communications from the base station 40 to the installer tool 18 may include information that signals from the RMIs 23, 24, and 26 are or are not being received, power levels, information for how often the scheduled communications were not received, the power levels from the RMIs 23, 24, and 26, the power outages at the base station 40, and other health and diagnostic information from the RMIs 23–26 and base station 40. Communications from the installer tool 18 to the base station 40 may include the desired scheduling interval for the RMI 23–26, the initial dial reading for the RMI 26 for the corresponding meter 14, and other parameters and diagnostic information intended for the RMIs 23–26 and the base station 40.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A method for field installation of a particular one of multiple remote interfaces to a particular one of multiple base stations, comprising steps of:

transmitting an installation signal in one or more installation signal bursts, said installation signal including a base station identification (ID) corresponding to said particular base station and a particular remote interface ID corresponding to said particular remote interface, said particular base station programmed to recognize only certain recognizable remote interface IDs corresponding to certain recognizable ones of said multiple remote interfaces, respectively, and said base station ID;

decoding signal energy for said installation signal at said particular base station;

recognizing said base station ID in said installation signal; and designating said particular remote interface ID as one of said recognizable remote interface IDs for designating said particular remote interface as one of said recognizable remote interfaces, thereby enabling communication with said particular remote interface.

2. The method of claim 1, further including steps of:

alternating between a scheduled time segment and an acquisition time segment;

receiving scheduled communications with one or more active ones of said multiple remote interfaces during said scheduled time segment;

receiving said signal energy during said acquisition time segment;

decoding information in said signal energy for determining when said signal energy includes one of (i) a first of said installation signal bursts including said base station ID or (ii) a data signal burst including a first of said recognizable remote interface IDs from a first of said recognizable remote interfaces;

responding to said first installation signal burst by scheduling a next installation signal burst during said acquisition time segment; and responding to said data signal burst by scheduling a next data signal burst with said first recognizable remote interface during said scheduled time segment.

3. The method of claim 1, further including steps of:

transmitting a first said installation signal burst including said base station ID from an installer tool;

receiving an acknowledgment signal at said installer tool; and transmitting a second said installation signal burst including said particular remote interface ID from said installer tool.

4. The method of claim 1, further including steps of:

transmitting a first said data signal including said particular remote interface ID from said particular remote interface;

receiving signal energy for said first data signal at said base station;

recognizing said particular remote interface ID at said base station; and responding to said data signal by transmitting a return signal.

5. The method of claim 4, wherein:

said return signal includes information for scheduling a second said data signal from said particular remote interface.

6. The method of claim 5, further including a step of:

receiving me asurement information at said particular remote interface.

7. The method of claim 6, further including steps of:

receiving said return signal a t said particular remote interface; and transmitting said second data signal including said measurement information from said particular remote interface.

8. The method of claim 7, further including a step of:

receiving sa id second data signal at said base station;

concentrating said meas urement information with other inf ormation at said base station; and issuing said concentrated information via a wide area network to a centr al office.

9. The method of claim 1, wherein:

said particular remote interface is a remote meter interface (RMI) for reading a meter.

10. A base station for receiving scheduled data signals from multiple remote interfaces that are active and an installation signal for installing a particular one of said multiple remote interfaces, comprising:

a receiver for receiving data signal bursts from said active remote interfaces according to a schedule and receiving signal energy for an installation signal having one or more installation signal bursts, said installation signal including said b as e station ID and a part icular remote interface ID corresponding to said particular remote interface;

a memory including an installation code and identification data including a base station ID corresponding to the base station and certain recognizable remote interface IDs corresponding, respectively, to certain recognizable ones of said multiple remote interfaces from which data signals are not being received according to said schedule; and a microcontroller coupled to the memory and the receiver for following instructions in said installation code for recognizing said base station ID and responding to said installation signal by including said particular remote interface ID among said recognizable remote interface IDs, thereby enabling said base station for communication with said particular remote interface.

11. The base station of claim 10, wherein:

the memory further includes a communication code including instructions for alternating between a scheduled time segment for communicating with said active remote interfaces and an acquisition time segment for receiving said signal energy;

said signal energy further includes a data signal burst including a first of said recognizable remote interface IDs from a first of said recognizable remote interfaces; and said installation code further includes instructions for responding to a first of said installation signal bursts by scheduling a next said installation signal burst during said acquisition time segment and responding to said data signal burst by scheduling a next data signal burst with said first recognizable remote interface during said scheduled time segment.

12. The base station of claim 11, further including:

a transmitter coupled to the microcontroller for transmitting an acknowledgment signal burst including said scheduling for said next installation burst and a return signal for transmitting a return signal burst including said scheduling for said next data signal burst.

13. The base station of claim 10, further including:

a wide area network interface for issuing concentrated information to a wide area network; and wherein said communications code further includes instructions for collecting information received in several data signal bursts and providing said concentrated information.

14. The base station of claim 10, wherein:

at least one of said multiple remote interfaces is a remote meter interface (RMI) for reading a meter.

15. A system for communicating between multiple remote interfaces and multiple base stations where each of said remote interfaces communicates with only one of said base stations, comprising:

said mul tiple remote interfaces;

said multiple base stations;

a particular one of said remote interfaces that is to be installed, the particular remote interface having an associated remote interface identification (ID);

an installation tool for transmitting an installation signal in one or more installation signal bursts having a particular base station ID corresponding to a particular one of said base stations to which the particular remote interface is to be installed;

said particular base station including: a memory including an installation code and identification data for certain recognizable remote interface IDs corresponding, respectively, to certain recognizable ones of said remote interfaces and said particular base station ID; a receiver for receiving data signal bursts from active ones of said multiple remote interfaces and receiving signal energy for said installation signal; and a microcontroller coupled to the memory and the receiver for following instructions in said installation code for recognizing said base station ID and responding to said installation signal by including said particular remote interface ID as one said recognizable remote interface IDs, thereby enabling said particular base station for said communication with said particular remote interface.

16. The system of claim 15, wherein:

said memory further includes a communication code including instructions for alternating between a scheduled time segment for communicating with said active remote interfaces and an acquisition time segment for receiving said signal energy;

said signal energy further includes a data signal burst including a first of said recognizable remote interface IDs from a first of said recognizable remote interfaces; and said installation code further includes instructions for responding to a first of said installation signal bursts by scheduling a next said installation signal burst during said acquisition time segment and responding to said data signal burst by scheduling a next data signal bursts from said first recognizable remote interface during said scheduled time segment.

17. The system of claim 16, wherein:

said particular base station further includes a transmitter coupled to the microcontroller for transmitting an acknowledgment signal including said scheduling for said installation signal and a return signal for transmitting a return signal including said scheduling for said data signal.

18. The system of claim 16, wherein:

said particular base station further includes a wide area network interface for issuing concentrated information to a wide area network; and said communication code further includes instructions for collecting information received in said several data signal bursts and providing said concentrated information.

19. The system of claim 15, wherein:

at least one of said multiple remote interfaces is a remote meter interface (RMI) for reading a meter.

* * * * *